United States Patent [19]

Wyatt

[11] 4,448,398

[45] May 15, 1984

[54] WINCH CONTROL SYSTEM

[75] Inventor: Lloyd A. Wyatt, Elk River, Minn.

[73] Assignee: Garlock Equipment Company, Plymouth, Minn.

[21] Appl. No.: 353,018

[22] Filed: Mar. 1, 1982

[51] Int. Cl.[3] ..... B66D 1/44; B66D 1/48

[52] U.S. Cl. ..... 254/361

[58] Field of Search ..... 254/360, 361, 362

[56] References Cited

U.S. PATENT DOCUMENTS

| | | | |
|---|---|---|---|
| 3,458,053 | 7/1969 | Reuter | 254/361 X |
| 3,817,033 | 6/1974 | Appel et al. | 254/361 X |
| 3,819,156 | 6/1974 | Sieracki | 254/361 X |
| 3,871,714 | 3/1975 | Behrend | 254/361 X |
| 3,915,022 | 10/1975 | Walton | 254/361 X |
| 3,990,552 | 11/1976 | Muntjanoff | 254/361 X |
| 4,047,311 | 9/1977 | Kelley | 254/361 X |
| 4,074,891 | 2/1978 | Ritter | 254/361 |
| 4,275,870 | 6/1981 | Henneman et al. | 254/361 |

*Primary Examiner*—John Petrakes

*Attorney, Agent, or Firm*—Schroeder, Siegfried, Vidas & Arrett

[57] ABSTRACT

A winch control system for a crane or the like; the winch including a rotatable spool. A motor is connected for rotating the spool while a dual state brake is connected to prevent spool rotation in one state while permitting spool rotation in its other state. A power source provides energy to drive the motor and to change the state of the brake. Control elements selectively interconnect the power supply with the brake and motor, the interconnection of the power supply and motor being responsive to the interconnection of the brake and power supply.

14 Claims, 6 Drawing Figures

WINCH CONTROL SYSTEM

DESCRIPTION

1. Background of Prior Art

The present invention relates to a crane and, particularly, to a winch control system for a crane.

Booms have long been used to facilitate the raising or lowering of a load at an elevated work site. Such booms have been incorporated into cranes and offer the advantage of maintaining the load at a distance from the building or other structure on which the crane is positioned. Winches have been employed to increase the mechanical advantage or "lifting power" of the crane with a spool playing out or taking in cable.

Powered winches have the advantage of greatly reducing the manpower necessary to raise or lower a load of a given weight. Such powered cranes have long been in use. An example of such a crane is disclosed in U.S. Pat. No. 2,591,974 issued Apr. 8, 1952 to Smith for TRAVERSING HOIST, which is hereby incorporated by reference. The crane of the incorporated patent employs a winch that is powered during the lifting or raising of the load with a brake controlling the lowering of the load. The brake is a one-way acting brake.

BRIEF SUMMARY OF INVENTION

The present invention provides a crane having a powered winch, the winch being powered during both the raising and lowering of a load. A brake is also provided, the brake being disengaged from the winch simultaneously with the application of driving force to the winch. On removal of the driving force, the brake is automatically engaged preventing further movement of the winch. Thus, the load can be stopped at any height, during raising or lowering, to be maintained at that height by the brake until power is again applied to the winch. This provides a positive winch control of the load.

In a preferred embodiment, the winch has a spool which is powered by a hydraulic motor while the brake is a normally engaged brake that is disengageable on the application of sufficient hydraulic pressure. Hydraulic power is provided to the motor by a variable output hydraulic pump. A valve connects the brake to a source of hydraulic pressure, another pump, for example. The movement of a lever is employed to control the valve with the variable pump being mechanically linked to the lever such that lever movement also controls pump output. In this manner, the brake may be disengaged while the driving of the motor is simultaneously initiated.

In the disclosed embodiment, the lever controls a cam with a cam follower controlling the state of the valve and, accordingly, the application of pressure to the brake. A bifurcated yoke straddles the lever such that the yoke is moved in response to movement of the lever. Yoke movement controls the output, including flow direction, of a variable speed hydraulic motor. A mechanism employing a single control stick to control both lever movement and operating speed of a prime mover driving the variable output pump is disclosed.

DETAILED DESCRIPTION OF INVENTION

Figure 1:
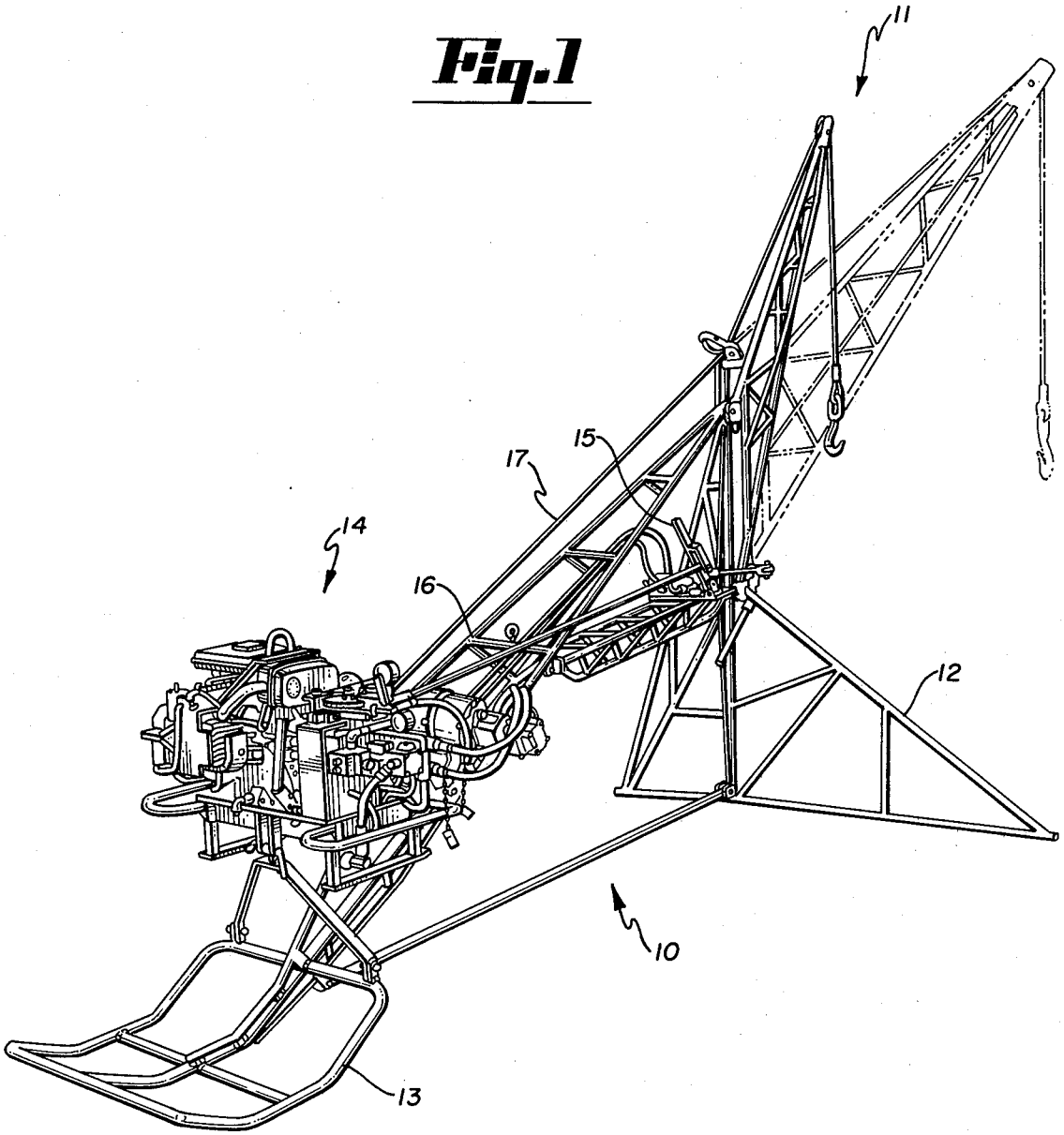
FIG. 1 illustrates a crane in which the control system of the present invention may be advantageously employed.

FIG. 1 illustrates a crane that may advantageously employ the control system of the present invention. The crane of FIG. 1 includes a base portion 10 and a swing arm 11, the swing arm 11 being rotatable between an extended position (shown in phantom) and a retracted position (shown in solid lines). Base 10 includes an A-frame support 12, a cradle 13 and cooperating booms and braces, the cradle 13 being configured to accept counterbalancing weight, in known manner. The crane of FIG. 1 is further described in concurrently filed application Ser. No. 353,017 filed in the name of Lloyd A. Wyatt for PORTABLE CRANE, now abandoned, which is commonly owned with the present invention and which is hereby incorporated by reference.

The crane of FIG. 1 supports a power and power control system designated generally at 14. A control stick 15 is carried by the crane and connected to control elements of the power and control system 14 by a rod 16, all to be described more fully below. A cable 17 extends over a pulley carried by the swing arm 11 and terminates in a hook by which a load may be raised or lowered.

Figure 2:
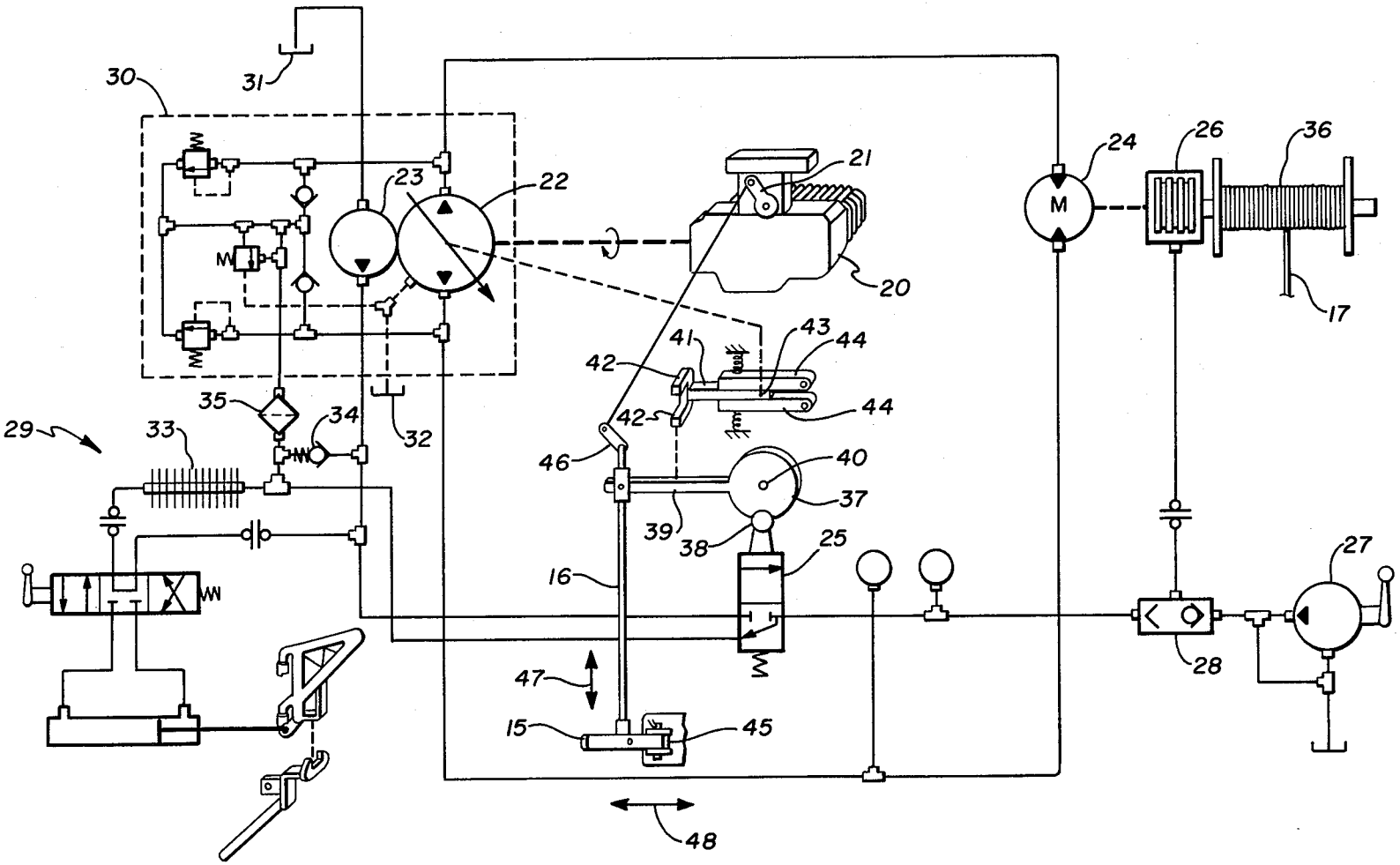
FIG. 2 is a schematic illustrating the operation of the control system of the present invention.

FIG. 2 schematically illustrates the power supply and its control in accordance with the present invention. A prime mover 20, such as a gasoline engine, is provided with a throttle 21, the throttle 21 controlling the speed of the engine 20, in known manner. The output shaft of the prime mover 20 is connected to power a variable output hydraulic pump 22 and a second hydraulic pump 23. Both outputs of the pump 22 are connected to a hydraulic motor 24, the speed of the motor 24 being dependent on the output of the pump 22 while its direction of rotation is dependent on the direction of the output from the pump 22. The output of pump 23 is connected to an isolation valve 25, the isolation valve 25 interconnecting the pump 23 with a brake 26. A hand pump 27 is provided, together with a shuttle valve 28, to allow manual disengagement of the brake 26. However, in normal operation, the valve 28 will connect the valve 25 to the brake 26. Those elements of FIG. 2 designated generally at 29 are employed in the control of the swing arm 11 of FIG. 1 and are shown here for the purpose of completeness of disclosure although they form no part of the present invention.

Pumps 22 and 23 are contained within a box 30 which designates generally the pumping function of the present invention. The pump 30 is supplied with hydraulic fluid from a reservoir 31 while it exhausts to a second reservoir 32. Various check valves and relief valves are provided within the pump 30, in known manner. An oil cooler 33, relief valve 34 and filter 35 are also provided.

The motor 24 and brake 26 are connected to a winch 36, the winch cable 17 (see FIG. 1)being that which raises and lowers the desired load. The brake 26 is essentially a dual state brake, its normal state being a braking state with the braking action being removed on the application of sufficient pressure on the line which connects it to the valve 25. Such brakes are known in the prior art and typically produce their braking action by springs.

Pressure to overcome the braking action of the brake 26 is provided by the pump 23 under the control of the valve 25. Valve 25 is a two-position valve having a normal position wherein the output of pump 23 is not connected to the brake 26. However, valve 25 may be moved under the influence of a cam 37 and follower 38 to a position wherein it interconnects the output of the pump 23 to the brake 26. Assuming that output is sufficient, the pressure at the output of pump 23 will override the spring bias within the brake 26 thereby releasing the braking action of the brake 26. On return of the valve 25 to the position illustrated in FIG. 2, the input of the brake 26 is connected to another line for pressure relief.

Cam 37 is connected to a lever 39, movement of the lever causing rotation of the cam 37 about an axis 40 and depression of the follower 38. Depression of the follower 38 will move the valve 25 and apply pressure to the brake 26.

A bifurcated yoke 41 has its furculae 42 positioned one on each side of the lever 39 and rotates about an axis 43. The axes 40 and 43 are generally coincident such that movement of the lever 39 engages one of the furculae 42 causing the yoke 41 to rotate. The yoke 41 is mechanically linked to the variable output pump 22 such that movement of yoke 41 about the axis 43 will control the output of the variable output pump 22. Return arms 44 lie along each side of the yoke 41 and are spring biased so as to impart a return force on the yoke 41 when it is moved under the control of the lever 39.

A control stick 15 is secured at a universal joint 45 and has an extending rod 16 secured to the lever 39 (See also FIG. 1). A toggle arrangement 46 connects the rod 16 to the primer mover throttle 21. Movement of the control stick 15 in the direction of the arrow 47 will induce a movement within the lever 39 thus controlling the valve 25 while movement in the direction of the arrow 48 will be transferred, through the toggle 46, to the throttle 21 thus controlling the speed of the prime mover 20. From rest, and with the prime mover 20 running, control stick 15 may be used to speed up the motor after which the lever 39 may be moved to result in a disengagement of the brake 26 while the motor 24 begins to drive the winch 36. During a control operation of this type, the planes in which the control stick 15 moves are generally perpendicular to each other.

Figure 3:
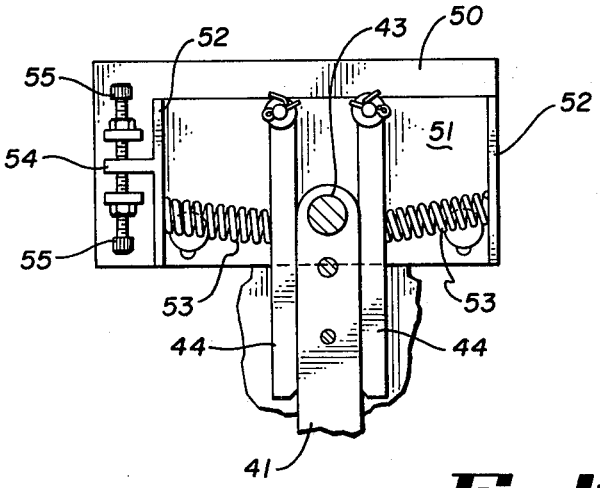
FIG. 3 illustrates an implementation of a portion of the control system of FIG. 2.
Figure 4:
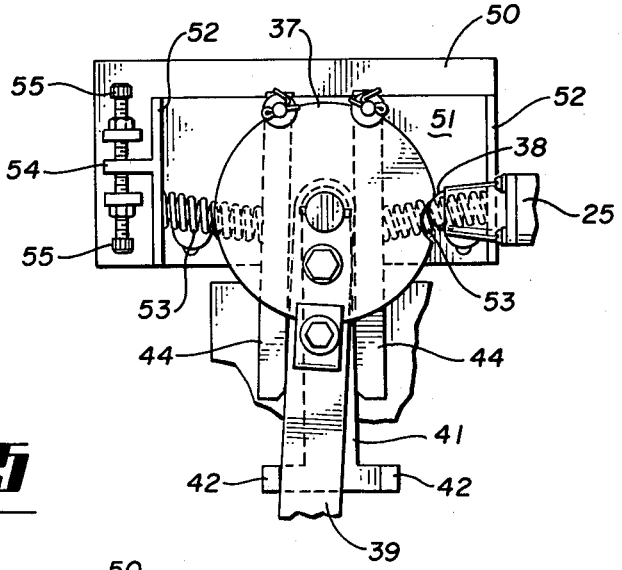
FIGS. 4 and 5 further illustrate a preferred implementation of the control system of FIG. 2.
Figure 5:
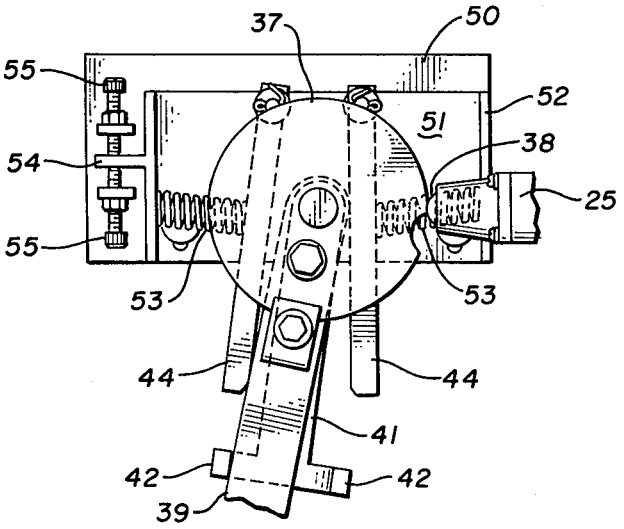

FIGS. 3–5 illustrate the interaction between the lever 39 and yoke 41, and their associated elements. FIG. 3 shows a plate 50 supporting the other elements. The plate 50 may be a portion of the crane or a support carried by the crane. Mounted on the support plate 50 is a housing 51 having upstanding sidewalls 52. Extending between the sidewalls 52 and return arms 44 are springs 53, the springs 53 being compression springs. A tab 54 extends from one of the sidewalls 52 to lie between two bolts 55 carried on lugs extending from the plate 50, the plate 51 being rotatable relative to the plate 50 with the tab 54 and bolts 55 serving as an adjustment for their relative angular orientation. The axis 43 is shown as a shaft. The mechanical linkage between the yoke 41 and the pump 22 may be via the shaft 43 which turns in response to a movement of the yoke 41.

FIGS. 4 and 5 show those elements illustrated in FIG. 3 and, additionally, the yoke furculae 42, cam 37, follower 38 and portions of lever 39 and valve 25. The distance between the furculae 42 is greater than the width of the lever 39 such that the lever 39 may be moved a slight distance before engaging the furculae 42. This position is illustrated in FIG. 4 which further illustrates that the cam 37 is beginning to engage the follower 38 to depress it and establish communication between the pump 23 and brake 26. Further movement of the lever 39 will cause further depression of the follower 38 and opening of the valve 25 as well as movement of the yoke 41 by engagement of the lever 39 with a furculae 42. Movement of the yoke 41, as discussed above, will vary the output of the pump 22. The direction of yoke movement will determine the direction of pump 22 output flow while the amount of movement will determine the amount of flow. Further, the yokes engage one of the return arms 45 causing its associated spring 53 to compress. That compression will have a tendency to urge the yoke 41 to a neutral (no output from pump 22) position when the lever is moved to allow the follower 38 to fully extend from the valve 25. The return arms 44, and associated springs 53, are necessary because of the difference between the spacing between furculae 42 and the width of the lever 39. The tab 54 and bolts 55 provide an adjustment for the neutral yoke position.

Figure 6:
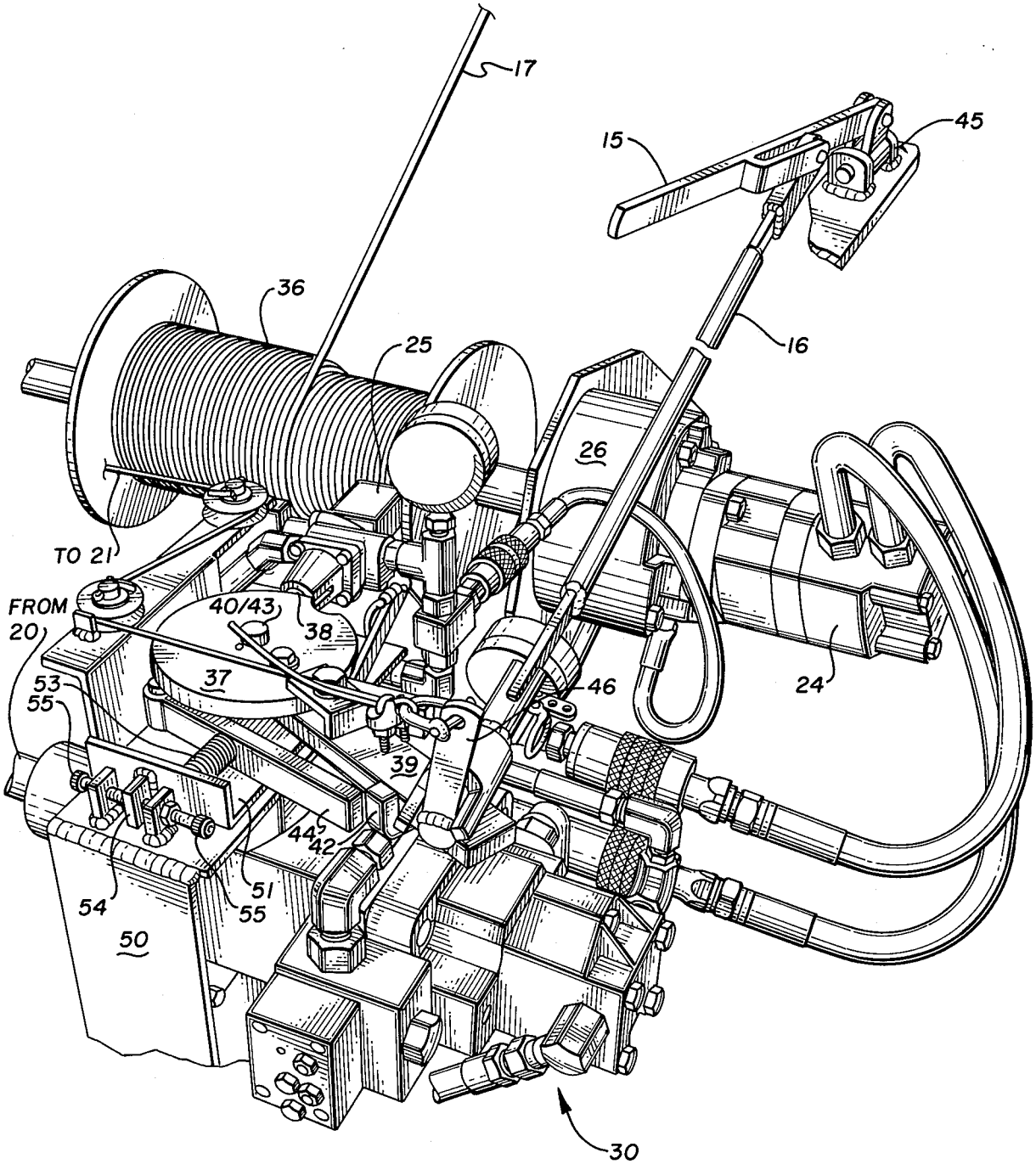
FIG. 6 illustrates a preferred embodiment of the present invention.

Obviously, many modifications and variations of the present invention are possible in light of the above teachings. For example, FIG. 6 illustrates a perspective view of a preferred embodiment of the present invention illustrating several of the elements described above. However, other implementations are possible without departing from the scope of the present invention. It is therefore to be understood that, within the scope of the appended claims, the invention may be practiced otherwise than as specifically described.

I claim:

1. In a crane of the type having a winch including a rotatable spool, an improved winch control system which comprises:

motor means connected for rotating said spool; dual state brake means connected for preventing spool rotation in one state and permitting spool rotation in the other state;

power means including means for providing driving energy for said motor means and means providing state changing energy for said brake means; and control means including first means for selectively interconnecting said brake means and said state changing energy providing means and second means responsive to said first means for selectively providing said driving energy to said motor means.

2. The crane of claim 1 wherein said brake means is normally in said one state and changes to said other state in response to said state changing energy.

3. The crane of claim 1 wherein said first means includes a lever movable to selectively interconnect said brake means and said changing energy providing means, said second means including means mechanically linked to said lever and responsive to movement of said lever for selectively providing driving energy to said motor means.

4. The crane of claim 3 wherein said mechanically linked means comprises bifurcated yoke means, said lever lying between and engageable with the furculae of said yoke means.

5. The crane of claim 4 wherein said first means comprise rotatable cam means and follower means, said lever being connected to rotate said cam means.

6. The crane of claim 5 wherein said yoke means is pivotable about an axis, said axis coinciding with the center of rotation of said cam means.

7. The crane of claim 6 wherein said motor means driving energy means comprises variable output means, the angular orientation of said yoke establishing the output of said variable output means.

8. The crane of claim 7 wherein said brake means is normally in said one state and changes to said other state in response to said state changing energy.

9. The crane of claim 8 wherein said motor means, brake means and power means comprise hydraulic means, said power means further comprising prime mover means, and said control means comprising valve means.

10. The crane of claim 9 further comprising universal control stick means linked to said prime mover means for speed control thereof by movement generally in a plane and linked to said lever for movement thereof by movement in a second plane perpendicular to the first plane movement of said control stick in one plane causing a reorientation of the other plane.

11. The crane of claim 10 wherein said driving energy providing means comprises variable output hydraulic pump means.

12. The crane of claim 11 wherein the distance between said yoke means furculae is greater than the dimension of that portion of the lever that lies between said furculae.

13. The crane of claim 12 further comprising means for biasing said yoke means to a neutral position.

14. The crane of claim 13 wherein said brake means is normally in said one state and changes to said other state in response to said state changing energy.

* * * * *